US011670915B2

(12) United States Patent
Trebbels

(10) Patent No.: US 11,670,915 B2
(45) Date of Patent: Jun. 6, 2023

(54) COMPOSITE SPARKING COMPONENT FOR A SPARK PLUG AND METHOD OF MAKING THE SAME

(71) Applicant: FEDERAL-MOGUL IGNITION GMBH, Neuhaus-Schierschnitz (DE)

(72) Inventor: Rene Trebbels, Erkelenz (DE)

(73) Assignee: FEDERAL-MOGUL IGNITION GMBH, Neuhaus-Schierschni (DE)

( * ) Notice: Subject to any disclaimer, the term of this patent is extended or adjusted under 35 U.S.C. 154(b) by 0 days.

(21) Appl. No.: 17/520,909

(22) Filed: Nov. 8, 2021

(65) Prior Publication Data

US 2022/0149598 A1 May 12, 2022

Related U.S. Application Data

(60) Provisional application No. 63/112,913, filed on Nov. 12, 2020.

(51) Int. Cl.
*H01T 13/32* (2006.01)
*H01T 13/39* (2006.01)
*H01T 21/02* (2006.01)

(52) U.S. Cl.
CPC ..... *H01T 13/32* (2013.01); *H01T 13/39* (2013.01); *H01T 21/02* (2013.01)

(58) Field of Classification Search
CPC ..... H01T 13/32; H01T 13/39; H01T 21/02; H01T 13/20
See application file for complete search history.

(56) References Cited

U.S. PATENT DOCUMENTS 4,906,889 A 3/1990 Dibert
5,202,601 A * 4/1993 Takamura ..... H01T 13/39 313/11.5
5,563,469 A * 10/1996 Takamura ..... H01T 13/39 313/142

(Continued)

FOREIGN PATENT DOCUMENTS

DE 102004032723 A1 2/2006
DE 102006025835 A1 12/2007

(Continued)

OTHER PUBLICATIONS

International Search Report and Written Opinion issued for PCT/IB2021/060472 dated Feb. 3, 2022; 13 pages.

*Primary Examiner* — Kevin Quarterman
(74) *Attorney, Agent, or Firm* — Reising Ethington, P.C.

(57) ABSTRACT

A composite sparking component for a spark plug that has a thin precious metal layer with a series of grooves attached to an underlying base layer. The grooves allow the precious metal layer, and hence the entire composite sparking component, to be more easily bent or formed into a desired shape, while at the same time minimizing the amount of precious metal and providing enhanced sparking sites along the edges of the grooves. In one example, the composite sparking component is a sleeve-shaped component attached to a center electrode. In a different example, the composite sparking component is a ring-shaped component attached to a ground electrode. The precious metal layer may be bonded to the base layer in the form of a bimetal laminate structure, or the precious metal layer can be built on the base layer with the use of additive manufacturing, to cite several possibilities.

18 Claims, 6 Drawing Sheets

(56) References Cited

U.S. PATENT DOCUMENTS

| | | | | |
|---|---|---|---|---|
| 8,217,561 | B2 | 7/2012 | Fukuzawa et al. | |
| 9,385,510 | B2 | 7/2016 | Deguchi et al. | |
| 9,735,552 | B2 * | 8/2017 | Yamada | H01T 13/32 |
| 9,825,432 | B2 * | 11/2017 | Deguchi | H01T 13/32 |
| 2007/0252503 | A1 | 11/2007 | Rossi | |
| 2016/0064903 | A1 * | 3/2016 | Deguchi | H01T 21/02 313/120 |

FOREIGN PATENT DOCUMENTS

| | | | |
|---|---|---|---|
| DE | 202009004414 | U1 | 6/2009 |
| DE | 102015114453 | A1 | 3/2016 |
| EP | 3306762 | A1 | 4/2018 |
| JP | H0684582 | A | 3/1994 |
| JP | 5255661 | B2 | 8/2013 |
| JP | 6460969 | B2 | 1/2019 |
| WO | WO2006017687 | A2 | 2/2006 |
| WO | WO2009059340 | A1 | 5/2009 |

* cited by examiner

COMPOSITE SPARKING COMPONENT FOR A SPARK PLUG AND METHOD OF MAKING THE SAME

FIELD

This disclosure generally relates to spark plugs and other ignition devices for use with various types of engines and, in particular, to spark plugs with a composite sparking component attached to a center electrode, a ground electrode or both.

BACKGROUND

Spark plugs can be used to initiate combustion in various types of engines, including internal combustion engines. Spark plugs typically ignite a gas, such as an air/fuel mixture, in an engine cylinder or combustion chamber by producing a spark across a spark gap that is defined between two or more electrodes. Ignition of the gas by the spark causes a combustion reaction in the combustion chamber that is responsible for the power stroke of the engine. The high temperatures, high electrical voltages, rapid repetition of combustion reactions, and the presence of corrosive materials in the combustion gases can create a harsh environment in which the spark plug must operate. This harsh environment can contribute to erosion and corrosion of the electrodes that can negatively affect the performance of the spark plug over time, potentially leading to a misfire or some other undesirable condition.

To reduce erosion and corrosion of the spark plug electrodes, various types of precious metals and their alloys—such as those made from platinum and iridium—have been used. These materials, however, can be costly. Thus, spark plug manufacturers sometimes attempt to minimize the amount of precious metal on an electrode by using such materials only at a firing tip or sparking component of the electrode where a spark jumps across a spark gap. Manufacturing such a firing tip or sparking component, however, can be challenging, as certain precious metal materials, like those made from iridium or ruthenium, are oftentimes very hard, brittle and/or otherwise difficult to work with and to form into desired shapes.

SUMMARY

According to one example, there is provided a composite sparking component, comprising: a base layer; and a precious metal layer attached to the base layer, wherein the precious metal layer includes a plurality of grooves.

In accordance with various embodiments, the spark plug may have any one or more of the following features, either singly or in any technically feasible combination:

- the base layer and the precious metal layer are bonded together as a laminate structure with a bimetal junction located therebetween, the bimetal junction metallurgically and physically joins the base layer and the precious metal layer together without a weld;
- the base layer and the precious metal layer are bonded together as an additive manufactured structure with a powder deposition junction located therebetween, the powder deposition junction metallurgically and physically joins the base layer and the precious metal layer together without a weld;
- the composite sparking component is a cylindrical-shaped sleeve or a circular-shaped ring and extends between a first axial end and a second axial end;

- the base layer is on a radially inner side of the composite sparking component and is configured for attachment to a center electrode of a spark plug, and the precious metal layer is on a radially outer side of the composite sparking component and is configured to face a spark gap and act as a sparking surface;
- the base layer is on a radially outer side of the composite sparking component and is configured for attachment to a ground electrode or a ground electrode holder of a spark plug, and the precious metal layer is on a radially inner side of the composite sparking component and is configured to face a spark gap and act as a sparking surface;
- the base layer is made from a nickel-based material, and the precious metal layer is made from at least one of the following materials: a platinum-based material, an iridium-based material, a ruthenium-based material or a gold-based material;
- each of the base layer and the precious metal layer has a thickness in a radial direction that is between 0.1 mm and 0.5 mm, inclusive;
- the plurality of grooves extend in an axial direction between first and second axial ends of the composite sparking component, and each of the plurality of grooves includes a groove floor located circumferentially between a pair of precious metal ridges;
- each of the plurality of grooves has a groove depth Z that extends all the way through a thickness of the precious metal layer so that the groove floor is in the underlying base layer;
- each of the plurality of grooves has a groove depth Z that extends partially through a thickness of the precious metal layer so that the groove floor is in the precious metal layer;
- each of the plurality of grooves has a groove width X that is between 0.03 mm and 0.6 mm, inclusive;
- each of the pair of precious metal ridges has a ridge width Y that is between 0.3 mm and 0.8 mm, inclusive;
- each of the plurality of grooves has a groove width X, each of the pair of precious metal ridges has a ridge width Y, and a ratio X:Y is between 0.1-0.5, inclusive;
- each of the plurality of grooves has a groove angle θ that is between 5°-50°, inclusive;
- the groove floor is flat and each of the pair of precious metal ridges is square or rectangular in shape;
- the groove floor is angled and each of the pair of precious metal ridges is trapezoidal in shape; and
- a spark plug, comprising: a shell having an axial bore; an insulator being at least partially located in the shell axial bore and having an axial bore; a center electrode being at least partially located in the insulator axial bore; a ground electrode attached to the shell; and the composite sparking component of claim 1, wherein the base layer is attached to one of the center electrode or the ground electrode and the precious metal layer faces the other of the center electrode or the ground electrode across a spark gap.

According to another example, there is provided method of making a composite sparking component, comprising the steps of: creating a grooved composite sheet having a base layer and a precious metal layer with a plurality of grooves; bending or forming the grooved composite sheet into an unattached composite sparking component; and securing the unattached composite sparking component to a center electrode, a ground electrode or both.

In accordance with various embodiments, the spark plug may have any one or more of the following features, either singly or in any technically feasible combination:

the creating step further comprises providing a composite sheet with the base layer and the precious metal layer bonded together as a laminate structure with a bimetal junction located therebetween, and forming the plurality of grooves in the precious metal layer so as to create the grooved composite sheet; and the creating step further comprises providing a base layer and using an additive manufacturing process to build the precious metal layer on the base layer as an additive manufactured structure with a powder deposition junction located therebetween, and forming the plurality of grooves at the same time that the precious metal layer is built so as to create the grooved composite sheet.

DRAWINGS

Preferred embodiments will hereinafter be described in conjunction with the appended drawings, wherein like designations denote like elements, and wherein.

DESCRIPTION

Figure 1:
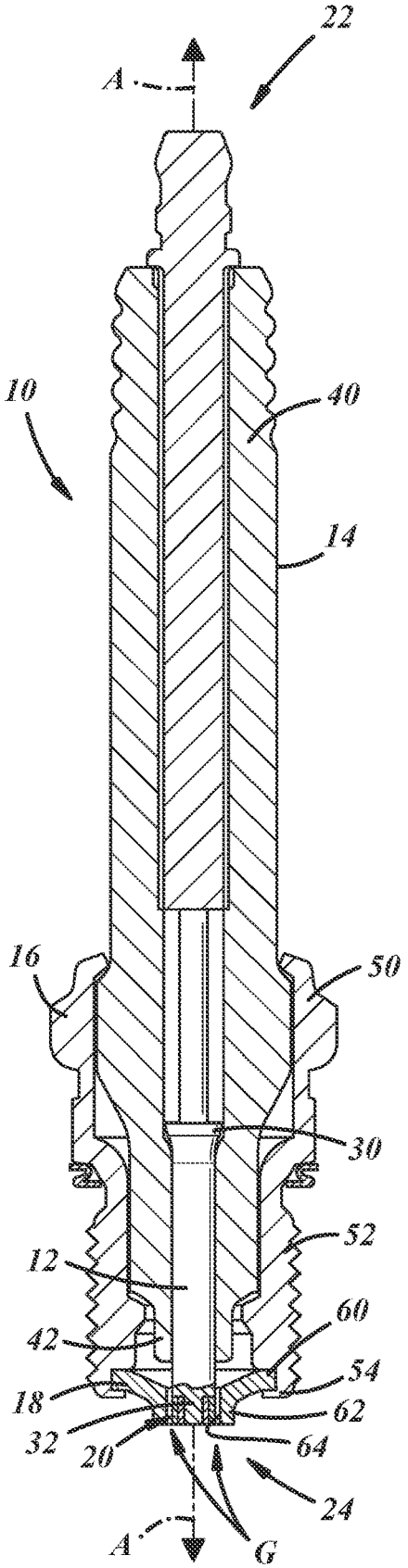
FIG. 1 is a cross-sectional view of a spark plug with a composite sparking component attached to a center electrode.

The composite sparking component described herein includes a thin precious metal layer attached to an underlying base layer. The precious metal layer has a series of small grooves or channels formed therein so that the precious metal layer, and hence the entire composite sparking component, can be more easily bent or formed into a desired shape, while at the same time minimizing the amount of expensive precious metal that is needed and providing enhanced sparking sites along the edges of the grooves. The grooves allow the precious metal layer, which is oftentimes made from a hard or brittle precious metal material, to be more easily bent or formed into a sleeve, tube, cylinder, ring, or other annular shape. According to one example, the composite sparking component is a sleeve-shaped component with a base layer and a precious metal layer having a series of grooves on an exterior side. The sleeve-shaped composite sparking component can be slid onto and attached to a free end of a center electrode so that it faces one or more ground electrodes across a spark gap and acts as a sparking surface. In a different example, the composite sparking component is a ring-shaped component that is attached to a ground electrode holder and has a base layer and a precious metal layer with a series of grooves on an interior side so that it can face a center electrode across a spark gap and provide an improved sparking surface.

The composite sparking component may be used in a variety of spark plugs and other ignition devices including automotive plugs, industrial plugs, aviation igniters, glow plugs, and/or any other device that is used to ignite an air/fuel mixture in an engine, in a generator or in another piece of machinery (e.g., mixtures involving gasoline, diesel, natural gas, hydrogen, propane and/or some other fuel.). This includes, but is certainly not limited to, the exemplary spark plugs that are shown in the drawings and are described below. Furthermore, it should be appreciated that the composite sparking component may be attached to a center electrode, a ground electrode or both; the composite sparking component may be provided in the form of a sleeve, tube, cylinder, ring, arc, circle, disk and/or other suitable shapes; and the composite sparking component may be comprised of two or more layers of different types of materials, to cite several possibilities. Other embodiments and applications of the composite sparking component are also possible.

Referring to FIG. 1, there is shown an exemplary spark plug 10 that generally includes a center electrode 12, an insulator 14, a metallic shell 16, a ground electrode 18, a composite sparking component 20, a terminal end 22 and a firing end 24. It should be appreciated that this non-limiting example has only been provided to illustrate one possible implementation for the composite sparking component of the present application, which may be used in any number of other ignition devices, especially those with center and/or ground electrodes having cylindrical, circular or other types of annular sparking surfaces. In the example of FIG. 1, both the center electrode 12 and the ground electrode 18 have cylindrical sparking surfaces, however, only the center electrode is shown with a composite sparking component 20 attached thereto. It should be appreciated that the composite sparking component of the present application could be attached to the ground electrode 18 as well (e.g., in addition to or in lieu of component 20 being attached to the center electrode 12). Other embodiments and implementations of the composite sparking component are certainly possible and envisioned by the present disclosure. Unless stated otherwise, the terms "axial," "radial," "diametrical" and "circumferential," as used herein, generally refer to the central or longitudinal axis A shown in the drawings.

Center electrode 12 is disposed within an axial bore of the insulator 14 and, according to one embodiment, is made from a high temperature alloy, such as a nickel-based material (e.g., Inconel 600, 601), and is generally cylindrical in shape. The center electrode 12 may have a thermally conductive core, such as one made from a copper-based material, to help manage the thermal energy near the firing end 24, but this is not necessary. At an upper end of the center electrode 12 is a head portion 30, which is diametrically enlarged so that it can engage and be supported by a corresponding interior shoulder of the insulator axial bore, and at an opposite lower end of the center electrode is a firing portion 32. The firing portion 32 is located towards the firing end 24 of the spark plug and, according to one embodiment, is machined or drawn down to be slightly diametrically reduced so that the sleeve-shaped composite sparking component 20 can be slid onto and attached to the center electrode 12. In this embodiment, the firing portion 32 of the center electrode 12 is cylindrical-shaped, the composite sparking component 20 is sleeve- or tubular-shaped, and the composite sparking component 20 is attached to and circumferentially surrounds an exterior surface of the firing portion 32 so that the two pieces are coaxial and concentric with one another.

Insulator 14 is disposed within an axial bore of the metallic shell 16 and is constructed from a material, such as a ceramic material, that is sufficient to electrically insulate or isolate the center electrode 12 from the metallic shell 16. The insulator includes a terminal portion 40 located near the terminal end 22 of the spark plug, and a nose portion 42 located near the firing end 24 of the spark plug. In the example of FIG. 1, the nose portion 42 is retracted up into the axial bore of the shell 16, but this is not necessary, as the nose portion could extend the same degree as the shell or it could extend beyond the shell.

Shell 16 carries the insulator 14 and other components of the spark plug, and is typically made from a high strength metal, such as steel. The shell 16 includes a locking portion 50, a threaded portion 52, and an end portion 54. As understood by those skilled in the art, the locking portion 50 may include a flange at an upper end that can be bent downwardly and inwardly in order to tightly engage an exterior shoulder of the insulator 14. This engagement, along with other potential features such as a hot lock portion, enable the locking portion 50 to securely retain the insulator 14 within the axial bore of the shell 16. The locking portion 50 may also include a hex-type or other feature so that the spark plug can be installed or removed from the cylinder head with a wrench or other tool. The threaded portion 52 may be located closer to the firing end 24 than the locking portion 50 and, as its name suggests, includes threads on an exterior surface for installation in a threaded hole in the cylinder head. The outer diameter of the threaded portion 52 can vary in size, depending on the particular engine it is to be used with, but is typically between 8 mm (M8) and 14 mm (M14), inclusive. The end portion 54 of the shell may be located closer to the firing end 24 than the threaded portion 52 and provides a surface to which the ground electrode 18 can be attached. According to the example illustrated in FIG. 1, the ground electrode 18 is attached to an interior or inner side of the end portion 54 (e.g., in a pocket or groove formed on the interior side of the end portion 54), however, it is possible for the ground electrode to be attached to an axial or distal end surface of the end portion 54 instead.

Ground electrode 18 interacts with the center electrode 12 across a spark gap G and may be made from a high temperature alloy, such as a nickel-based material (e.g., Inconel 600, 601). The ground electrode 18 may have a thermally conductive core, such as one made from a copper-based material, to help manage the thermal energy near the firing end 24 of the spark plug, but this is not necessary. In the example shown in FIG. 1, the ground electrode 18 is an annular ground electrode that circumferentially surrounds the center electrode 12 and the composite sparking component 20, however, many other types of ground electrode configurations are possible. The ground electrode 18 includes an attachment portion 60 where the ground electrode is attached to the shell 16 and a firing portion 62 that opposes the composite sparking component 20 across the spark gap G, as shown in the drawings. According to this particular embodiment, the ground electrode 18 extends from the attachment portion 60 in a somewhat radially inward direction before bending downwards to the firing portion 62 in a somewhat axial direction. An interior side 64 of the firing portion 62 may have a cylindrical surface that circumferentially surrounds an exterior surface of the composite sparking component 20, which can also be cylindrical in shape. This creates an annular spark gap G between the center and ground electrodes 12, 18 (and more particularly, between the composite sparking component 20 and ground electrode 18). For natural gas applications, the initial spark gap G may be between 0.2 mm and 0.4 mm, inclusive; for hydrogen applications, the initial spark gap G may be between 0.1 mm and 0.3 mm, inclusive; and for automotive applications, the initial spark gap G may be between 0.6 mm and 0.8 mm, inclusive. Of course, the preceding dimensional ranges are merely non-limiting examples. As stated above, it is possible for the ground electrode 18 to have a composite sparking component attached on the interior side 64 so that it confronts the spark gap and acts as a sparking surface (this could be in addition to or in lieu of composite sparking component 20).

Composite sparking component 20 is a multi-layered component that can be attached to the center electrode 12, the ground electrode 18, or both in order to improve resistance against corrosion and/or erosion and, thereby, improve the durability of the spark plug 10. According to the embodiment shown in FIGS. 1-4, the composite sparking component 20 is a generally cylindrical component that includes an underlying base layer 70, a precious metal layer 72 with a series of grooves or channels 74, a first axial end 76, and a second axial end 78. As will be discussed in more detail, the precious metal layer 72 may be bonded or clad onto the underlying base layer 70 so that together the layers form a laminate or composite structure. Furthermore, the series of grooves 74 are formed in the precious metal layer 72 so that it can be more easily bent into a sleeve-, tube-, cylinder-, ring-, circular- and/or annular-shaped form, as well as other suitable shapes. The grooves 74 can be particularly helpful when the precious metal layer 72 is made from a hard or brittle material, such as an iridium- or ruthenium-based material, as these materials do not bend easily.

Figure 2:
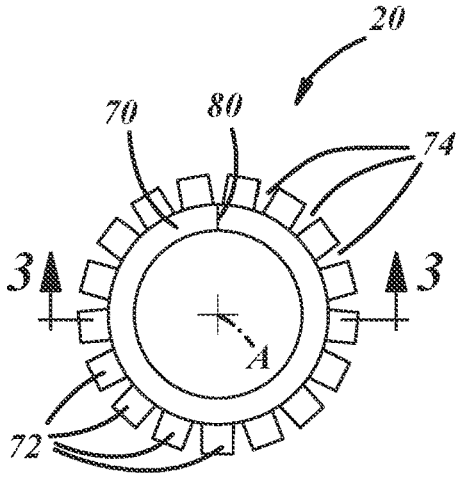
FIG. 2 is a top view of the composite sparking component from FIG. 1.
Figure 3:
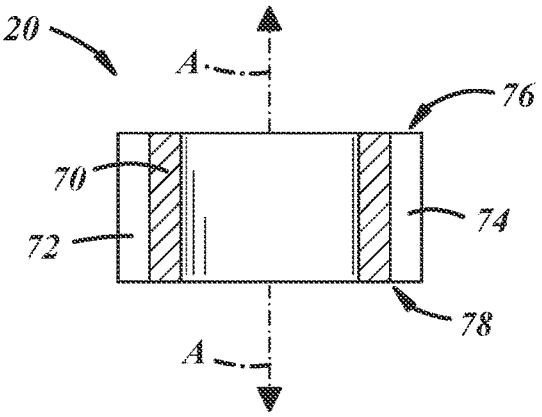
FIG. 3 is a cross-sectional view of the composite sparking component from FIG. 2.

Base layer 70, also referred to as a carrier or substrate layer, carries the precious metal layer 72 and is preferably made of a ductile material that can be bent or otherwise worked into a desired form. The base layer 70 may be made of a metal that is softer and/or more ductile than the corresponding precious metal layer 72, but this is not required. In one example, the base layer 70 is made from a nickel-based material (e.g., Inconel 600, 601) or some other high-temperature material with good oxidation resistance and thermal conductivity, and the base layer may have a thickness (i.e., radial thickness in FIGS. 2 and 3) between 0.1 mm and 0.5 mm, inclusive, or preferably between 0.2 mm and 0.5 mm, inclusive, or even more preferably between 0.2 mm and 0.4 mm, inclusive. As best seen in FIG. 3, the base layer 70 may extend the entire axial length of the composite sparking component 20, from the first axial end 76 to the second axial end 78, and is located on a radially inner side of the precious metal layer 72. If the composite sparking component 20 is initially made from a flat bimetal or laminate sheet that is then bent into a cylindrical or other shape, then the composite sparking component 20 may have a joined or welded seam 80, as shown in FIG. 2. If, on the other hand, the composite sparking component 20 is drawn or extruded using different metals for the different layers, then the component may be continuous in the circumferential direction such that it does not have such a seam. Although the composite sparking component embodiments shown herein are generally hollow (i.e., the base layer 70 is in the shape of a hollow sleeve, tube, ring, etc. so that it can be slid over top of a firing portion 32), it is also possible for the composite sparking component to have a solid form (i.e., the base layer 70 could be in shape of a solid cylinder with the precious metal layer 72 being located on its radial exterior). Base layer 70 is not the center electrode 12, rather the base layer is a separate part that is configured for attachment to the center electrode (e.g., base layer 70 can be welded to firing portion 32) or for attachment to an intervening component that attaches to the center electrode.

Precious metal layer 72, also referred to as a noble metal layer, is supported by the base layer 70 and provides the composite sparking component 20 with a sparking surface that faces the ground electrode 18 across the spark gap G. Although the precious metal layer 72 may include any number of suitable materials, according to some non-limiting examples, the precious metal layer is made from a platinum-based material (e.g., Pt—Ir10, Pt—Rh10), an iridium-based material (e.g., Ir—Rh2.5, Ir—Rh10, Ir—Rh (1.7-2.8 wt %)–W(0.0-0.5 wt %)–Zr(35-300 ppm)), a ruthenium-based material, or a gold-based material. The precious metal layer 72 may include a series of grooves or channels 74 that not only assist with bending or forming the precious metal layer, but also provide sharp groove edges 82 that can promote sparking and constitute sparking sites along the component. According to one embodiment, the precious metal layer 72 has a thickness (i.e., radial thickness in FIGS. 2 and 3) between 0.1 mm and 0.5 mm, inclusive, or preferably between 0.2 mm and 0.4 mm, inclusive, but this is not required.

Each of the grooves 74 may extend in the axial direction for the entire axial length of the precious metal layer 72, and the precious metal layer 72, in turn, may extend the entire axial length of the composite sparking component 20, from the first axial end 76 to the second axial end 78. Each of the grooves 74 can have a groove depth Z that penetrates and extends all the way through the thickness of the precious metal layer 72 so that groove floors 84 in the underlying base layer 70 are exposed (illustrated in FIG. 4). Alternatively, each of the grooves 74 may have a shallower groove depth Z that only partially extends into the precious metal layer 72 so that groove floors 86 are formed in the precious metal layer 72, and not the underlying base layer 70 (shown in broken lines). In another embodiment, the precious metal layer 72 may include grooves with different groove depths, where some grooves extend all the way through the precious metal layer to expose groove floors 84 in the base layer 70, while others only extend partially through the precious metal layer and create groove floors 86 in the precious metal layer 72. The groove depth Z may be between 0.1 mm and 0.5 mm, inclusive, or more preferably between 0.15 mm and 0.35 mm, inclusive. Each of the grooves 74 may have a common groove width X that is between 0.03 mm and 0.6 mm, inclusive, or more preferably between 0.03 mm and 0.3 mm, inclusive, or even more preferably between 0.03 mm and 0.15 mm, inclusive, or the grooves could have different groove widths. Precious metal ridges 92 are ridge-like sections of precious metal that, according to the example shown, extend in the axial direction in between adjacent grooves 74 with flat groove floors 84, 86, and are square or rectangular in shape. Each groove floor 84, 86 is located circumferentially between a pair of precious metal ridges 92. The precious metal ridges 92 can have a common ridge width Y that is between 0.3 mm and 0.8 mm, inclusive, or the ridge widths may vary, depending on the particular application. According to one example, at least some of the grooves 74 have a groove width X and at least some of the ridges 92 have a ridge width Y such that the ratio X:Y is from 0.1 to 0.5, inclusive, or more preferably from 0.1 to 0.3, inclusive.

Figure 4:
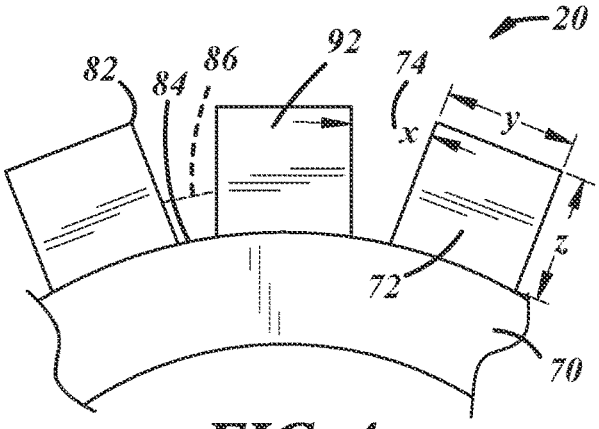
FIG. 4 is an enlarged top view of a section of the composite sparking component from FIG. 2.
Figure 5:
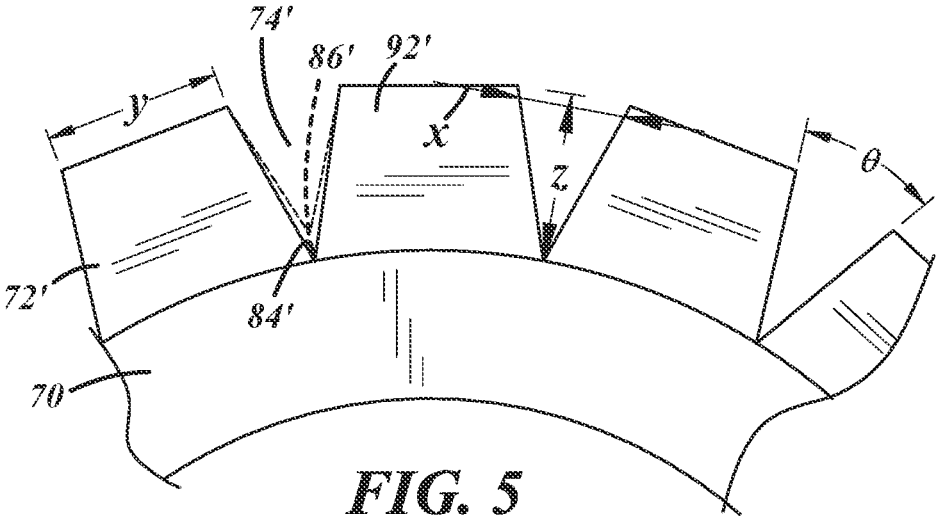
FIG. 5 is an enlarged top view of a section of another example of the composite sparking component.

With reference to FIG. 5, there is shown another potential example of the precious metal layer 72' where the grooves 74' are angled or tapered notches, as opposed to being straight or more squared off channels, like those shown in FIG. 4. The groove depth Z can extend all the way through the precious metal layer 72' so that an angled groove floor 84' is located at the underlying base layer 70, as shown, or the angle of the grooves 74' can be such that it reduces the groove depth Z and causes the angled groove floor 86' to be located in the precious metal layer 72', as shown in broken lines. The groove width X varies due to the angled or tapered nature of grooves 74', however, the groove width X may be between 0.03 mm and 0.6 mm, inclusive, or more preferably between 0.06 mm and 0.4 mm, inclusive, or even more preferably between 0.06 mm and 0.2 mm, inclusive. The groove angle θ (i.e., the overall angle from one side of a groove to the opposite side of the groove) may be between 5°-50°, inclusive, or preferably between 10°-40°, inclusive. The precious metal ridges 92' may be in the general shape of a trapezoid due to the angled or tapered nature of the grooves 74' and can have a ridge width Y that is between 0.3 mm and 0.8 mm, inclusive. As with the FIG. 4 embodiment, the size, shape, spacing, etc. of grooves 74' may be uniform (e.g., the grooves may have a common groove width X, common groove depth Z, common groove angle θ, etc.), they may vary from groove to groove (e.g., according to a pattern), or they may be arranged according to some other configuration. The materials used for the base and precious metal layers, the depth Z of the grooves, the width X of the grooves, the width Y of the precious metal ridges, as well as a number of other factors, may all impact the performance and/or wear characteristics of the composite sparking component 20. In the event that a groove is tapered or angled such that the corresponding groove width X varies within the groove (whether it be a slight groove width variation due to the composite sparking component 20 being bent into an annular shape so that the grooves open up, like in FIG. 4, or a more substantial groove width variation due to the grooves being purposely formed with a taper, like in FIG. 5), the groove width X should be measured at the outer radial end or opening of the groove, after the composite sparking component 20 is attached to an electrode. The same is true for the ridge width Y.

Figure 6:
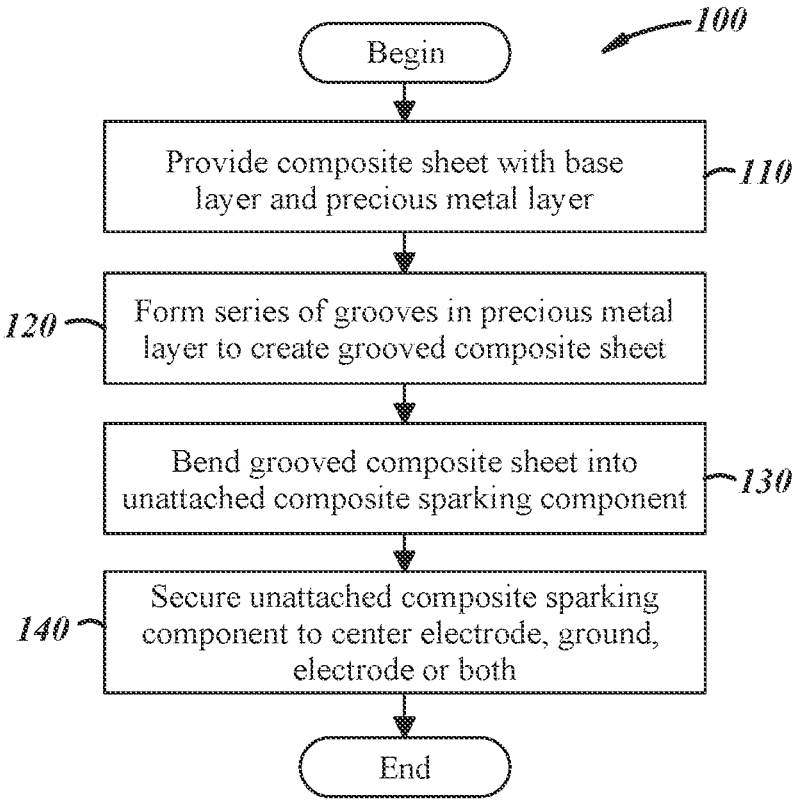
FIG. 6 is a flowchart of a method for making a composite sparking component.
Figure 7:
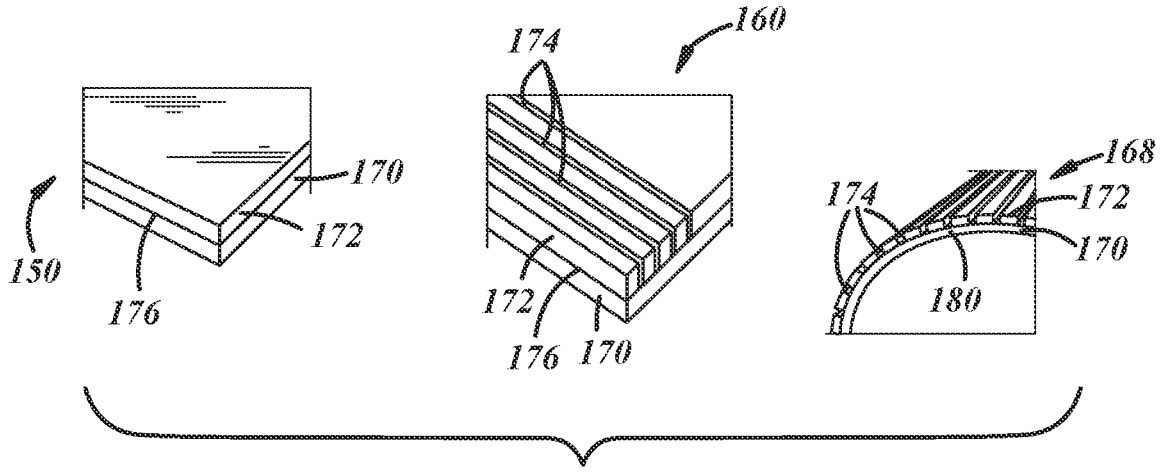
FIG. 7 illustrates some of the different steps or stages of the method of FIG. 6.

Turning now to FIGS. 6-7, a first example of a method 100 for making the composite sparking component is shown. It should be appreciated that this is only an example of a method or process that could be used to manufacture the composite sparking component of the present application and that other methods could certainly be used instead.

Starting with step 110, a composite sheet with a base layer and a precious metal layer is provided. According to one embodiment, step 110 provides a flat composite sheet 150 that includes a base layer 170 and a precious metal layer 172, where the two layers have been bonded, cladded, adhered and/or otherwise joined to one another so as to form a composite or laminate structure. Potential techniques for creating the composite sheet 150 include, but are not limited to: roll bonding (e.g., cold roll bonding, warm roll bonding, accumulative roll bonding, etc.) where the metal layers 170, 172 are rolled together using flat rollers and significant pressure such that the layers bond to one another; adhesive bonding, where the metal layers 170, 172 are adhered to one another using a thin thermoplastic or thermoset film layer that, when activated, cured, cross-linked, etc. bonds the two layers together; cladding where the different metal layers 170, 172 are extruded, pressed and/or rolled together under high pressure to create the composite sheet 150; and laser cladding, which is an additive manufacturing or 3D printing process, where one material (often in the form of powder or wire) is deposited on another material sheet with the use of laser. In one example illustrated in FIG. 7, the composite sheet 150 is provided according to one of the aforementioned techniques or the like so that a bimetal junction 176 is formed between the base layer 170 and the precious metal layer 172; the bimetal junction 176 does not include a traditional weldment and corresponding heat affected zone. Put differently, the bimetal junction 176 metallurgically and/or physically joins layers 170 and 172 together, as opposed to simply welding the two layers together by melting and solidifying material in the form of a traditional weldment and heat affected zone. Of course, other processes are certainly possible, as the present method is not limited to the aforementioned examples.

Turning to step 120, a series of grooves 174 are formed in the precious metal layer 172 of the composite sheet to form a grooved composite sheet 160. One of a number of different techniques may be used to form the grooves 174 including, but not limited to: cutting or physically machining the grooves 174, such as with a thin blade or other tool; pressing or stempeling the grooves 174 into the precious metal layer 172 (although this technique may not be suitable if the precious metal material is too hard); laser etching, ablating and/or otherwise forming the grooves 174 with the use of a laser; and electrical discharge machining (EDM) the grooves 174 with the use of rapidly reoccurring electrical discharges or sparks. Of course, other techniques may be used to form the grooves 174, and such grooves may extend all the way through the precious metal layer 172 so that the underlying base layer 170 is exposed (see, for example, groove floor 84, 84') or they may extend only part way through the precious metal layer so that precious metal is still exposed (see, for example, groove floor 86, 86').

In step 130, the grooved composite sheet is cut, blanked, bent, rolled and/or otherwise formed into an unattached composite sparking component 168. For an embodiment, like that shown in FIGS. 1-4, where the composite sparking component 20 is configured for attachment to a center electrode 12 so that it can face a corresponding ground electrode 18 across a spark gap G, the grooved composite sheet 160 may be bent or rolled into a sleeve, tube and/or cylindrical-shaped component 168 with the precious metal layer 172 on the radial outside of the base layer 170. This causes the grooves 174 to open in a radially outward direction. For embodiments where the composite sparking component is to be used on the ground electrode 18, for example, such that it faces a corresponding center electrode 12 across a spark gap G, the grooved composite sheet 160 may be rolled in such a way that the precious metal layer 172 is on the radial inside of the base layer 170 so that the grooves 174 open in a radially inward direction. Other composite sparking component configurations could be formed instead.

Step 140 secures the unattached composite sparking component 168 to a center electrode, a ground electrode or both. According to a non-limiting example, component 168 can be welded to the firing end 32 of the center electrode 12 so that the pieces become securely attached to one another. If the base layer 170 and the firing end 32 are both made from materials, such as nickel-based materials, that easily weld to one another, then resistance or laser welding may be used. If, on the other hand, the base layer 170 and/or the firing end 32 are made from materials with higher melting points, such as precious metals or the like, then a laser welding process may be more suitable. It may be desirable to carry out step 140 in such a way that a resulting weldment is not located along a sparking surface of the composite sparking component 20, and instead is turned or otherwise located at an out-of-the-way location, so as to not interfere with the performance of the spark plug. For those embodiments where the unattached sparking component 168 has been bent into a cylindrical, sleeve, circular, ring and/or other annular shape, an axially extending weld 180 will likely be needed in order to join the two sides of the component together. Weld 180 may be created during step 130 when component 168 is being bent or formed into shape, or it may be formed during step 140 when component 168 is being secured to an electrode. Other attachment techniques may be used instead.

Figure 8:
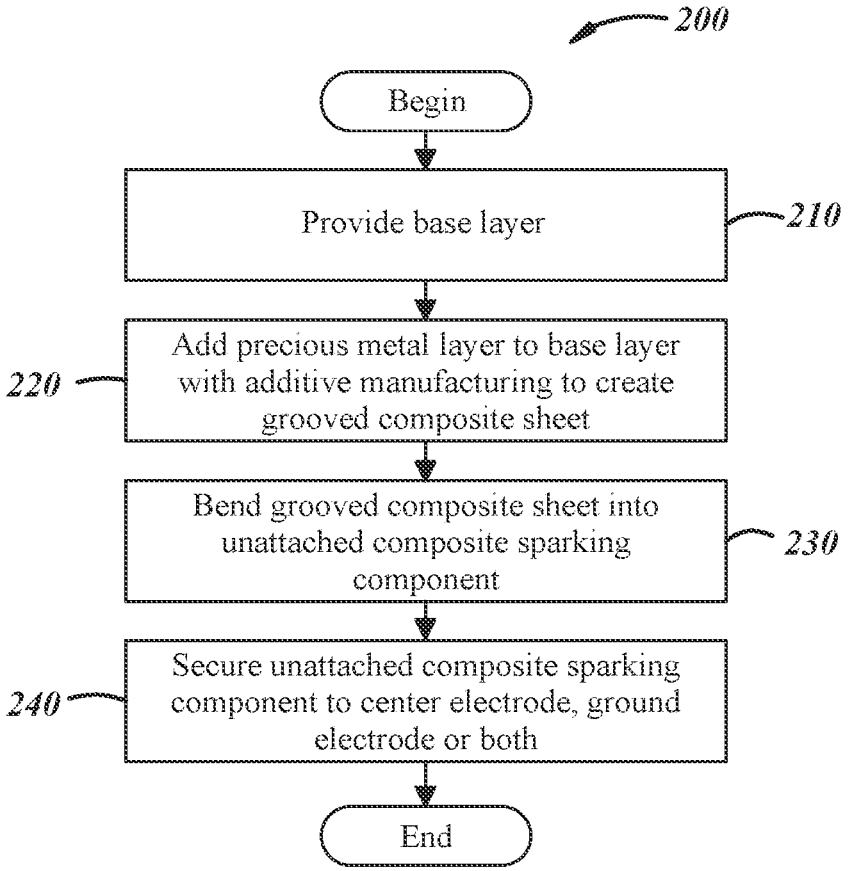
FIG. 8 is a flowchart of another method for making a composite sparking component, whereby this method uses an additive manufacturing step to create the precious metal layer.
Figure 9:
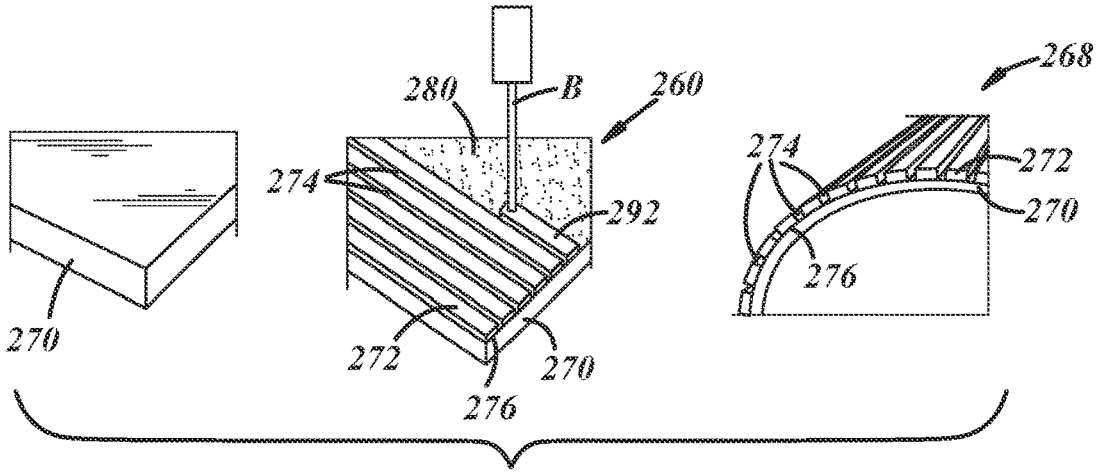
FIG. 9 illustrates some of the different steps or stages of the method of FIG. 8.

With reference to FIGS. 8-9, there is shown a second example of a method 200 for making a composite sparking component. Unlike the previous example, where the base layer 170 and the precious metal layer 172 were bonded or clad to one another first (step 110) and then the grooves 174 were formed therein (step 120) by removing precious metal material, in this example the precious metal layer 272 is applied or added to the base layer 270 at the same time that the grooves are formed through the use of additive manufacturing, also referred to as 3D printing. This process is able to minimize the amount of wasted precious metal, as precious metal is only applied to those areas where it is needed.

Starting with step 210, a base layer 270 is provided. The base layer 270 may be provided in the form of a flat or planar sheet or strip, it may be provided in the form of a roll, or it may be provided in a different suitable form. In terms of the composition, thickness and/or other characteristics of the base layer, the descriptions above pertaining to base layer 70, 170 apply here as well.

Next, the precious metal layer 272 is added to the base layer 270 using an additive manufacturing technique so that a grooved composite sheet 260 is formed, step 220. It should be appreciated that any number of different additive manufacturing processes may be used to create or build the grooved precious metal layer 272 on the base layer 270, including different powder deposition methods. In one example, a precious metal powder is maintained in a powder reservoir, a coating mechanism takes the precious metal powder from the reservoir and spreads or coats it on the base layer 270 in the form of a powder layer 280, which typically has a thickness between 20 μm and 100 μm. Once the powder layer is in place, a laser or energy beam B is directed at the powder layer 280 and follows a pattern corresponding to the object that is being built; in this case, the beam B follows a pattern that corresponds to the shape of the precious metal ridges 292 being built on the underlying base layer 270. After the laser or energy beam B melts (or sinters) the precious metal powder 280, it solidifies and forms a thin slice or deposition layer on the base layer 270; this process is then repeated such that the precious metal layer 272 is built up, layer by layer, until it reaches a desired height.

In one embodiment, the additive manufacturing process builds a very thin, first deposition layer for each of the precious metal ridges 292 (this is depicted in the middle panel of FIG. 9). The interface or boundary formed between the base layer 270 and the first deposition layer may include a powder deposition junction 276 that metallurgically and/or physically joins layers 270 and 272 together, as opposed to welding the two layers together, and is the result of an additive manufacturing process. Once a first deposition layer has been built for each precious metal ridge 292, the additive manufacturing process repeats the steps above in order to build second, third, fourth deposition layers, etc., one layer at a time on top of one another, until the desired thickness of the precious metal layer 272 is achieved (the precious metal layer thickness can be the same as the groove depth Z, but not always). In this way, the precious metal layer 272 is built one thin deposition layer at a time across all of the precious metal ridges 292, as opposed to each precious metal ridge being individually built and finished before moving on to another precious metal ridge. The resulting precious metal layer 272 includes a series of precious metal ridges 292 and intervening grooves 274 that are parallel to one another, similar to the previous example. Some additive manufacturing or 3D printing techniques that may be used include, but are not limited to, selective laser melting (SLM), selective laser sintering (SLS), laser cusing, direct metal laser sintering (DMLS), and electron beam melting (EBM), to cite a few. Step 220 may be carried out while the base layer 270 is a flat sheet or after it has been rolled up into a cylindrical or other form.

In steps 230 and 240, the grooved composite sheet 260 is cut, blanked, bent, rolled and/or otherwise formed into an unattached composite sparking component 268, and then the unattached composite sparking component is secured to an electrode, respectively. Once the composite sparking component is secured to an electrode, the grooves 274 and the interleafed ridges 292 may extend along the composite sparking component in an axial direction, although this is not required. Steps 230 and 240 may be largely the same as steps 130 and 140, respectively, in the preceding embodiment and, thus, are not repeated here. All of the teachings pertaining to steps 130 and 140 may apply to steps 230 and 240 as well.

Figure 10:
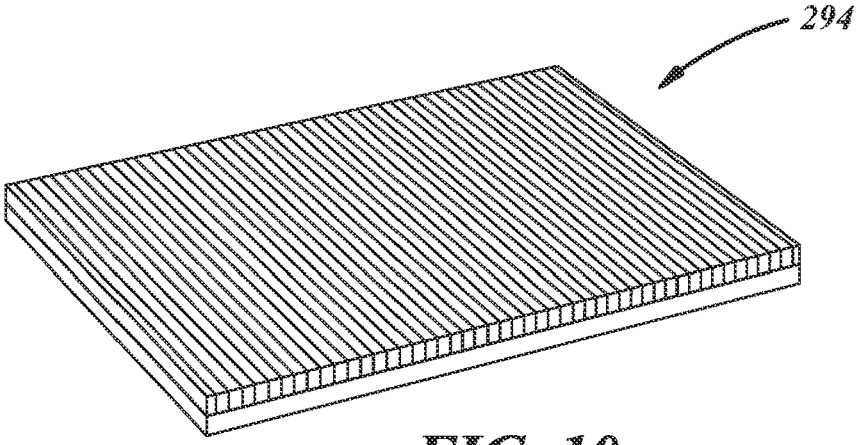
FIG. 10 is a perspective view of a grooved composite sheet in the form of a large sheet or panel.
Figure 11:
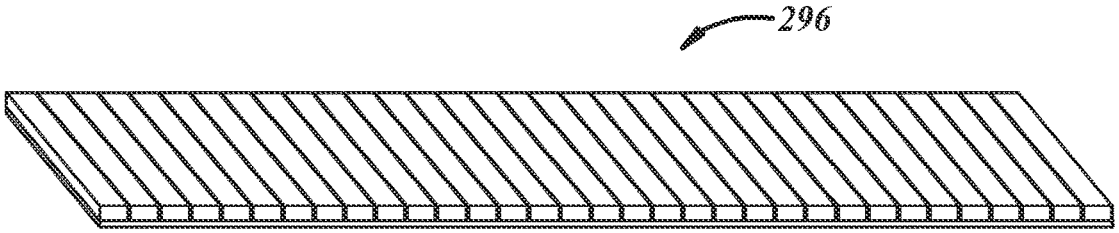
FIG. 11 is a perspective view of a grooved composite sheet in the form of an elongated strip, whereby precious metal ridges and grooves cover most or all of the strip.
Figure 12:
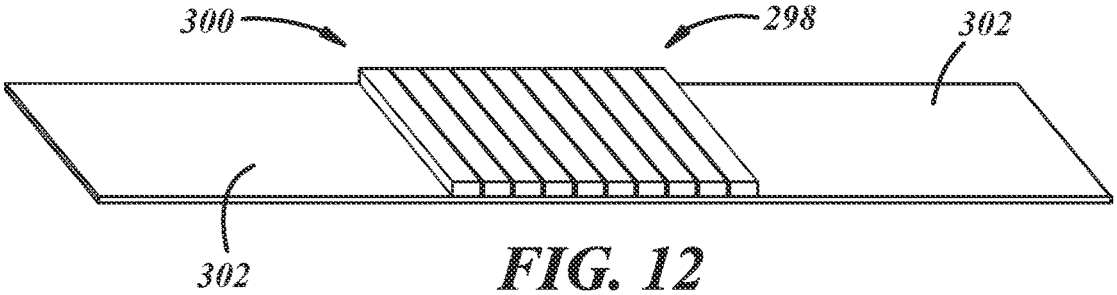
FIG. 12 is a perspective view of a grooved composite sheet in the form of an elongated strip, whereby precious metal ridges and grooves are selectively provided in certain strategic areas.

As mentioned above, method 200 is able to reduce precious metal waste since it only applies or deposits precious metal where it is needed and does not have to remove precious metal to form the grooves. Method 200 may also be preferable because it allows different precious metal ridges 292 to be built according to different heights, widths, shapes, sizes and patterns (e.g., additive manufacturing method 200 may be used to create the composite sparking components shown in FIGS. 4 and 5, as well as numerous other configurations by following different laser deposition patterns). It should be appreciated that the methods shown and described above are non-limiting examples of how a composite sparking component could be made and that the method of the present application is not limited thereto. For instance, steps 120 and/or 220 could be used to create a grooved composite sheet in the form of a large sheet or panel 294, as illustrated in FIG. 10, which could be subsequently cut or blanked into smaller strips or segments before proceeding to the next step. Alternatively, steps 120 and/or 220 could create a grooved composite sheet in the form of an elongated strip 296, as shown in FIG. 11, such that precious metal ridges and grooves cover most or all of the strip. In this embodiment, the elongated strip 296 may already be to size so that no cutting or blanking is required, or it could be further trimmed down to the necessary dimensions before advancing to the next step. In yet another embodiment shown in FIG. 12, steps 120 and/or 220 could be used to create a grooved composite sheet in the form of a panel or strip 298 that includes one or more sparking area(s) 300 and one or more non-sparking area(s) 302. The sparking area(s) 300 include an underlying base layer and a precious metal layer with ridges and grooves, as explained above, and they are selectively positioned on strip 298 so that they will confront a spark gap G and act as a sparking site once the composite sparking component is attached to an electrode. The non-sparking area(s) 302, on the other hand, only have a base layer and are intended for areas away from the spark gap G where no sparking occurs. The embodiment in FIG. 12 may be particularly well suited for applications where only a portion of the composite sparking component opposes an electrode across a spark gap and acts as a sparking site, such as some J-gaps and other non-annular spark gaps. Cost savings could be enjoyed with this embodiment, as it could substantially reduce the amount of precious metal that is needed.

FIGS. 13-19 show a variety of different embodiments where a composite sparking component has been added to a center electrode, a ground electrode or both. These embodiments are simply intended to illustrate some of the many ways in which the composite sparking component of the present application could be employed and, by no means, are meant to limit its scope. Other embodiments and applications of the composite sparking component are certainly possible.

Figure 13:
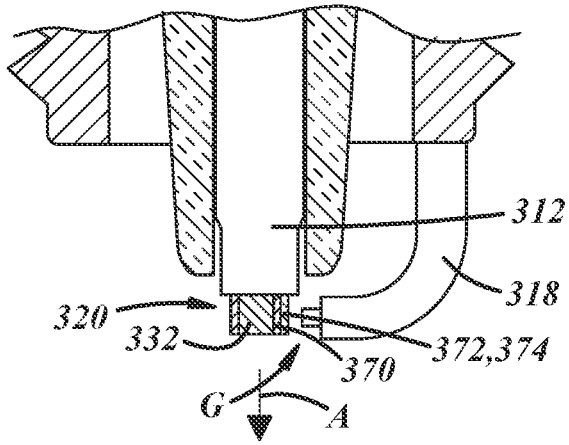
FIGS. 13-14 are views of other spark plugs with composite sparking components attached to center electrodes.
Figure 14:
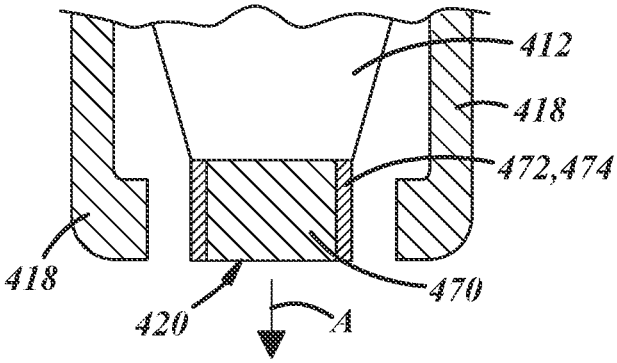

Starting with FIGS. 13 and 14, there are shown two different embodiments of a composite sparking component attached to a center electrode. In the FIG. 13 embodiment, a composite sparking component 320 is attached to a firing portion 332 of a center electrode 312. The composite sparking component 320 includes a base layer 370 and a precious metal layer 372 with grooves 374. In order to minimize the amount of precious metal used, composite sparking component 320 may only have the precious metal layer 372 in the area of the spark gap G which faces the distal end of the ground electrode 318 (the strip or panel 298 from FIG. 12 may be well suited for this embodiment such that the precious metal layer 372 corresponds to the sparking area 300). In the FIG. 14 embodiment, a composite sparking component 420 is attached to a distal or axial end surface of a center electrode 412, as opposed to circumferentially surrounding a firing portion. The composite sparking component 420 includes a base layer 470 that is solid and cylindrical and a precious metal layer 472 that is hollow and has grooves 474. The precious metal layer 472 is located on the outside of the base layer 470 and may either completely circumferentially surround the base layer or it could partially circumferentially surround the base layer so that precious metal is only present in the area of ground electrodes 418.

Figure 16:
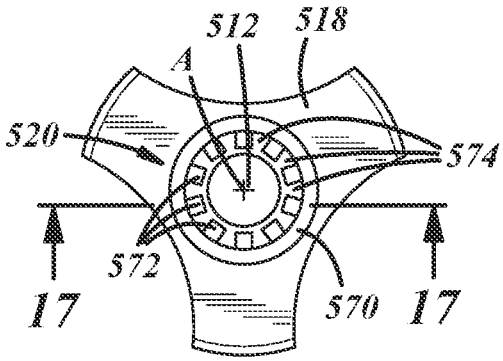
FIGS. 15-19 are views of other spark plugs with composite sparking components attached to ground electrodes.
Figure 15:
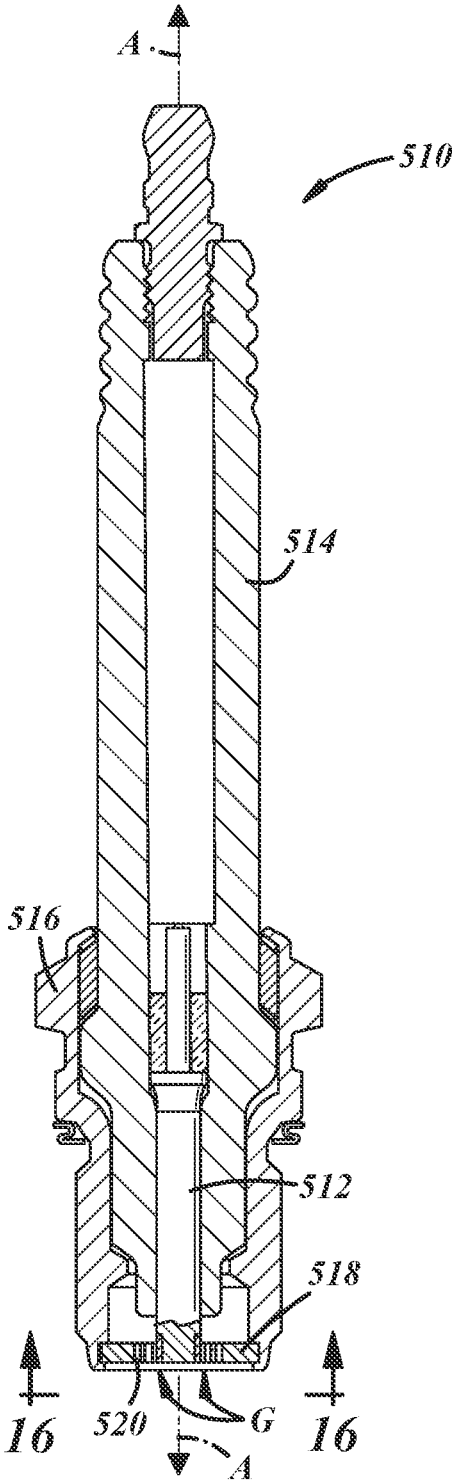
Figure 17:
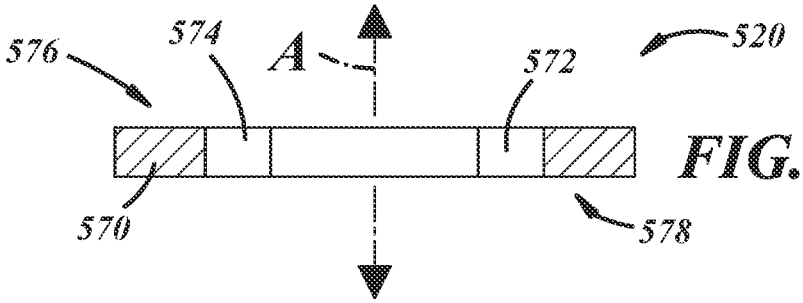

With reference to FIGS. 15-17, there is shown another embodiment of a spark plug 510 that generally includes a center electrode 512, an insulator 514, a metallic shell 516, a ground electrode 518, and a composite sparking component 520. This non-limiting example has only been provided to illustrate another possible implementation of the composite sparking component of the present application and the teachings set forth above apply to this embodiment as well.

Composite sparking component 520 is a generally circular component that includes a base layer 570, a precious metal layer 572 with a series of grooves or channels 574, a first axial end 576, and a second axial end 578. Unlike some of the previous embodiments, where the composite sparking component was in the shape of a sleeve, tube or cylinder, the composite sparking component 520 is more in the shape of a ring or circle. Furthermore, composite sparking component 520 is arranged so that base layer 570 is on the radial outside of the component and precious metal layer 572 is on the radial inside of the component.

Base layer 570 is designed for attachment to a ground electrode 518 (in this context, ground electrode 518 may constitute the ground electrode itself and/or a ground electrode holder) and may be comprised of the materials described above in connection with base layer 70. As best seen in FIG. 17, where the composite sparking component 520 has a flatter ring- or circular-shape than the previous embodiments, the base layer 570 may extend the entire axial length of the composite sparking component 520, from the first axial end 576 to the second axial end 578, and is located on a radially outer side of the precious metal layer 572. It is worth pointing out, base layer 570 is not the ground electrode 518, rather the base layer is a separate part that is configured for attachment to the ground electrode or for attachment to an intervening component that attaches to the ground electrode (e.g., base layer 570 can be welded to a ground electrode holder, which is attached to ground electrode 518). According to one embodiment, the base layer 570 has a thickness in the radial direction that is between 1.0 mm and 2.5 mm, inclusive, but this is not required.

Precious metal layer 572 is supported by the base layer 570 and provides the composite sparking component 520 with a sparking surface that faces the center electrode 512 across the spark gap G (the center electrode may or may not have a precious metal tip or sleeve of its own). The precious metal layer 572 may be made from any of the materials described above in connection with precious metal layer 72. Moreover, the precious metal layer 572 can include a series of grooves or channels 574, as described in the many examples above. In order to accommodate the configuration of FIGS. 15-17, where the precious metal layer 572 is located on the radial inside of the base layer 570, it may be desirable for the grooves 574 to have tapered or angled groove walls, as opposed to straight parallel walls, so that the precious metal layer 572 can be more easily bent or formed into the desired configuration. According to one embodiment, the precious metal layer 572 may have a thickness in the radial direction between 0.2 mm and 0.4 mm, inclusive, but this is not required.

Figure 18:
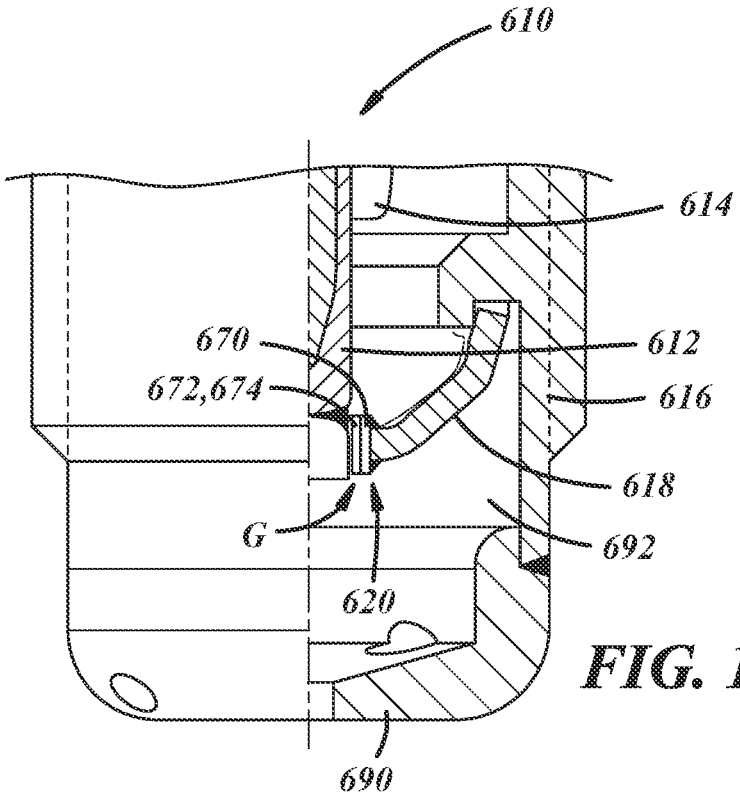
Figure 19:
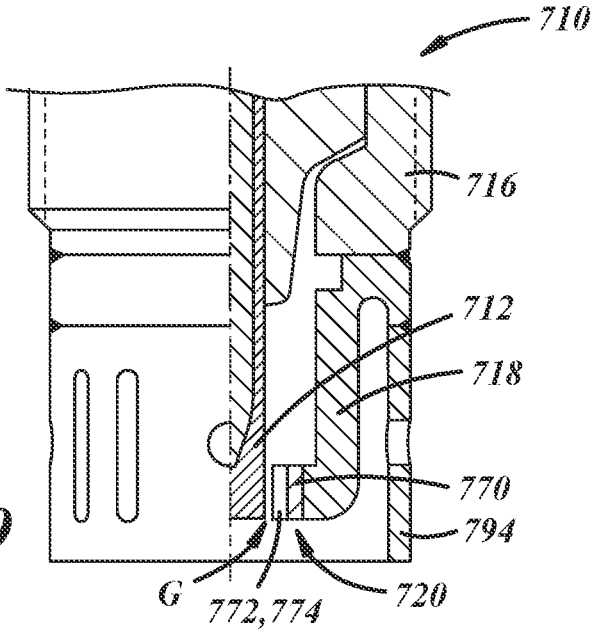

FIGS. 18 and 19 show additional embodiments where a composite sparking component is attached to a ground electrode. In the embodiment of FIG. 18, a spark plug 610 includes a center electrode 612, an insulator 614, a shell 616, a ground electrode or ground electrode holder 618, and a composite sparking component 620 attached on a radially inner side of the ground electrode 618 so that it circumferentially surrounds and opposes the center electrode 612 across a spark gap G. The composite sparking component 620 includes a base layer 670 and a precious metal layer 672 located on a radially inner side of the base layer, where the precious metal layer 672 may include a series of grooves 674 and precious metal ridges, as previously described. In this example, the spark plug 610 includes a prechamber wall 690 attached to a lower end of the shell 616 such that a pre-chamber 692 is formed. Skilled artisans will understand that spark plug 610 is a prechamber spark plug.

In the embodiment of FIG. 19, a spark plug 710 is provided with a composite sparking component 720 attached to a ground electrode or ground electrode holder 718 such that it circumferentially surrounds a center electrode 712. Like some of the previous embodiments, the composite sparking component 720 includes a base layer 770 and a precious metal layer 772 that is attached on an inner radial side of the base layer and includes a series of grooves and precious metal ridges formed therein. The composite sparking component 720 may be ring- or annular-shaped (or partially annular-shaped), and the grooves 774 and corresponding ridges can be aligned in the axial direction, as previously described. In this example, a shell skirt or extension 794 extends from the shell 716 and forms a swirl chamber around spark gap G. Again, these embodiments are simply provided to illustrate other examples of a how a composite sparking component with a base layer and a precious metal layer may be used. Other examples are certainly possible and are envisioned by the present application.

It is to be understood that the foregoing is a description of one or more preferred example embodiments of the invention, and the figures are examples that are not necessarily to scale. The invention is not limited to the particular embodiment(s) disclosed herein, but rather is defined solely by the claims below. Furthermore, the statements contained in the foregoing description relate to particular embodiments and are not to be construed as limitations on the scope of the invention or on the definition of terms used in the claims, except where a term or phrase is expressly defined above. Various other embodiments and various changes and modifications to the disclosed embodiment(s) will become apparent to those skilled in the art. All such other embodiments, changes, and modifications are intended to come within the scope of the appended claims.

As used in this specification and claims, the terms "for example," "e.g.," "for instance," "such as," and "like," and the verbs "comprising," "having," "including," and their other verb forms, when used in conjunction with a listing of one or more components or other items, are each to be construed as open-ended, meaning that the listing is not to be considered as excluding other, additional components or items. Other terms are to be construed using their broadest reasonable meaning unless they are used in a context that requires a different interpretation. In addition, the term "and/or" is to be construed as an inclusive OR. Therefore, for example, the phrase "A, B, and/or C" is to be interpreted as covering all of the following: "A"; "B"; "C"; "A and B"; "A and C"; "B and C"; and "A, B, and C."

The invention claimed is:

1. A composite sparking component, comprising:

a base layer configured for attachment to a separate center electrode of a spark plug or to a separate intervening component that attaches to a center electrode of a spark plug; and a precious metal layer attached to the base layer, the precious metal layer includes a plurality of grooves;

the composite sparking component is a cylindrical-shaped sleeve or a circular-shaped ring and extends between a first axial end and a second axial end;

wherein the base layer is on a radially inner side of the composite sparking component and is configured for attachment to the center electrode of the spark plug, and the precious metal layer is on a radially outer side of the composite sparking component and is configured to face a spark gap and act as a sparking surface.

2. A composite sparking component, comprising:

a base layer;

a precious metal layer attached to the base layer, the precious metal layer includes a plurality of grooves; and a joined seam, wherein each of the base layer and the precious metal layer has a thickness in a radial direction that is between 0.1 mm and 0.5 mm, inclusive, and the base layer and the precious metal layer with the grooves formed therein are configured such that the composite sparking component is bent into an annular shape or a sleeve shape where the joined seam joins edges of the composite sparking component together.

3. The composite sparking component of claim 2, wherein the base layer and the precious metal layer are bonded together as a laminate structure with a bimetal junction located therebetween, the bimetal junction metallurgically and physically joins the base layer and the precious metal layer together without a weld.

4. The composite sparking component of claim 2, wherein the base layer and the precious metal layer are bonded together as an additive manufactured structure with a powder deposition junction located therebetween, the powder deposition junction metallurgically and physically joins the base layer and the precious metal layer together without a weld.

5. The composite sparking component of claim 2, wherein the composite sparking component is a cylindrical-shaped sleeve or a circular-shaped ring and extends between a first axial end and a second axial end.

6. The composite sparking component of claim 2, wherein the base layer is on a radially outer side of the composite sparking component and is configured for attachment to a ground electrode or a ground electrode holder of a spark plug, and the precious metal layer is on a radially inner side of the composite sparking component and is configured to face a spark gap and act as a sparking surface.

7. The composite sparking component of claim 2, wherein the base layer is made from a nickel-based material, and the precious metal layer is made from at least one of the following materials: a platinum-based material, an iridium-based material, a ruthenium-based material, or a gold-based material.

8. The composite sparking component of claim 2, wherein the plurality of grooves extend in an axial direction between first and second axial ends of the composite sparking component, and each of the plurality of grooves includes a groove floor located circumferentially between a pair of precious metal ridges.

9. The composite sparking component of claim 8, wherein each of the plurality of grooves has a groove depth Z that extends all the way through a thickness of the precious metal layer so that the groove floor is in the underlying base layer.

10. The composite sparking component of claim 8, wherein each of the plurality of grooves has a groove depth Z that extends partially through a thickness of the precious metal layer so that the groove floor is in the precious metal layer.

11. The composite sparking component of claim 8, wherein each of the plurality of grooves has a groove width X that is between 0.03 mm and 0.6 mm, inclusive.

12. The composite sparking component of claim 8, wherein each of the pair of precious metal ridges has a ridge width Y that is between 0.3 mm and 0.8 mm, inclusive.

13. The composite sparking component of claim 8, wherein each of the plurality of grooves has a groove width X, each of the pair of precious metal ridges has a ridge width Y, and a ratio X:Y is between 0.1-0.5, inclusive.

14. The composite sparking component of claim 8, wherein each of the plurality of grooves has a groove angle θ that is between 5°-50°, inclusive.

15. The composite sparking component of claim 8, wherein the groove floor is flat and each of the pair of precious metal ridges is square or rectangular in shape.

16. The composite sparking component of claim 8, wherein the groove floor is angled and each of the pair of precious metal ridges is trapezoidal in shape.

17. A spark plug, comprising:

a shell having an axial bore;

an insulator being at least partially located in the shell axial bore and having an axial bore;

a center electrode being at least partially located in the insulator axial bore;

a ground electrode attached to the shell; and the composite sparking component of claim 2, wherein the base layer is attached to one of the center electrode or the ground electrode and the precious metal layer faces the other of the center electrode or the ground electrode across a spark gap.

18. The composite sparking component of claim 2, wherein the base layer is on a radially inner side of the composite sparking component and is configured for attachment to a center electrode of a spark plug, and the precious metal layer is on a radially outer side of the composite sparking component and is configured to face a spark gap and act as a sparking surface.

* * * * *